US010873124B2

(12) United States Patent
Chen et al.

(10) Patent No.: US 10,873,124 B2
(45) Date of Patent: Dec. 22, 2020

(54) MOBILE DEVICE

(71) Applicant: Wistron NeWeb Corp., Hsinchu (TW)

(72) Inventors: Ching-Wen Chen, Hsinchu (TW); Chia-Hao Chang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 9 days.

(21) Appl. No.: 16/550,713

(22) Filed: Aug. 26, 2019

(65) Prior Publication Data

US 2020/0076061 A1 Mar. 5, 2020

(30) Foreign Application Priority Data

Aug. 28, 2018 (TW) ..... 107129974 A

(51) Int. Cl.

| | |
|---|---|
| ***H01Q 1/24*** | (2006.01) |
| ***H01Q 9/28*** | (2006.01) |
| ***H01Q 21/00*** | (2006.01) |
| ***H01Q 21/06*** | (2006.01) |
| ***H01Q 1/36*** | (2006.01) |

(52) U.S. Cl.

CPC ..... *H01Q 1/243* (2013.01); *H01Q 1/36* (2013.01); *H01Q 9/285* (2013.01); *H01Q 21/0068* (2013.01); *H01Q 21/064* (2013.01)

(58) Field of Classification Search

CPC ..... H01Q 1/243; H01Q 1/36; H01Q 5/371; H01Q 5/364; H01Q 5/378; H01Q 9/285; H01Q 13/106; H01Q 21/0068; H01Q 21/064

See application file for complete search history.

(56) References Cited

U.S. PATENT DOCUMENTS

| | | | | |
|---|---|---|---|---|
| 10,056,696 | B2 | 8/2018 | Tseng et al. | |
| 2014/0078001 | A1* | 3/2014 | Matsuoka | H01Q 5/385 343/700 MS |
| 2017/0155198 | A1 | 6/2017 | Lo et al. | |
| 2017/0207542 | A1* | 7/2017 | Tseng | H01Q 13/106 |
| 2019/0027810 | A1* | 1/2019 | Li | H01Q 21/30 |
| 2019/0221943 | A1* | 7/2019 | Wu | H01Q 13/106 |
| 2020/0168993 | A1* | 5/2020 | Wei | H01Q 1/243 |
| 2020/0185831 | A1* | 6/2020 | Chen | H01Q 5/392 |

FOREIGN PATENT DOCUMENTS

| | | |
|---|---|---|
| TW | M537316 U | 2/2017 |
| TW | 201721972 A | 6/2017 |

* cited by examiner

*Primary Examiner* — Seokjin Kim
(74) *Attorney, Agent, or Firm* — McClure, Qualey & Rodack, LLP

(57) ABSTRACT

A mobile device includes a metal back cover, a dielectric substrate, a grounding metal element, a first radiation element, and a second radiation element. The metal back cover has a slot. The dielectric substrate has a first surface and a second surface, and the second surface faces the slot. The grounding metal element extends onto the first surface of the dielectric substrate. The first radiation element has a feeding point, and is disposed on the first surface of the dielectric substrate. The first vertical projection of the first radiation element at least partially overlaps the slot. The second radiation element is disposed on the second surface of the dielectric substrate. The second vertical projection of the second radiation element at least partially overlaps the slot. An antenna structure is formed by the first radiation element, the second radiation element, and the slot of the metal back cover.

20 Claims, 10 Drawing Sheets

MOBILE DEVICE

CROSS REFERENCE TO RELATED APPLICATIONS

This application claims priority of Taiwan Patent Application No. 107129974 filed on Aug. 28, 2018, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In a preferred embodiment, the disclosure is directed to a mobile device that includes a metal back cover, a dielectric substrate, a grounding metal element, a first radiation element, and a second radiation element. The metal back cover has a slot. The dielectric substrate has a first surface and a second surface which are opposite to each other. The second surface of the dielectric substrate faces the slot. The grounding metal element is coupled to the metal back cover, and extends onto the first surface of the dielectric substrate. The first radiation element has a feeding point, and is disposed on the first surface of the dielectric substrate. The first radiation element has a first vertical projection on the metal back cover, and the first vertical projection at least partially overlaps the slot. A coupling gap is formed between the first radiation element and the grounding metal element. The second radiation element is disposed on the second surface of the dielectric substrate. The second radiation element has a second vertical projection on the metal back cover, and the second vertical projection at least partially overlaps the slot. An antenna structure is formed by the first radiation element, the second radiation element, and the slot of the metal back cover.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
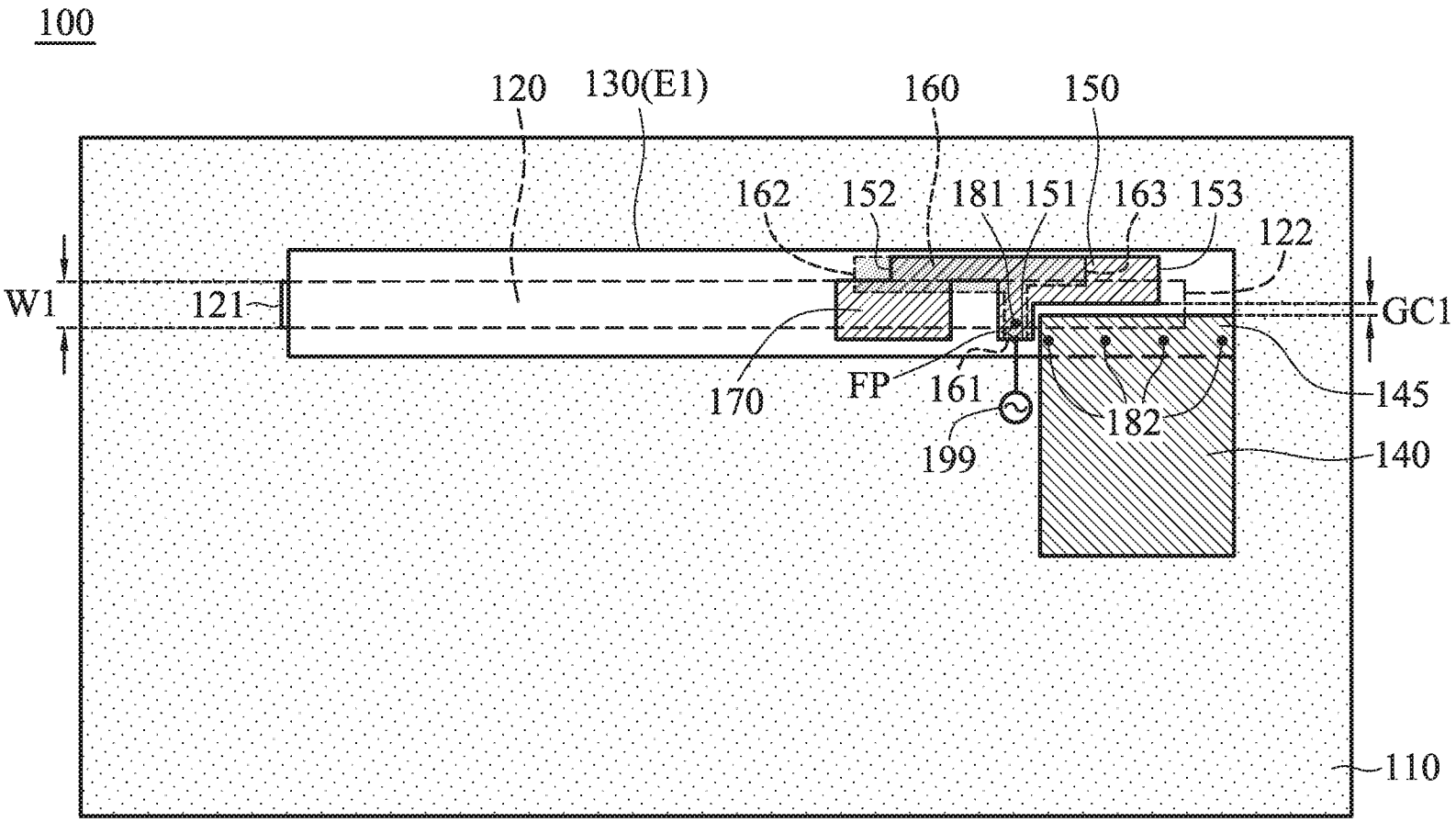
FIG. 1A is a top view of a mobile device according to an embodiment of the invention.
Figure 1B:
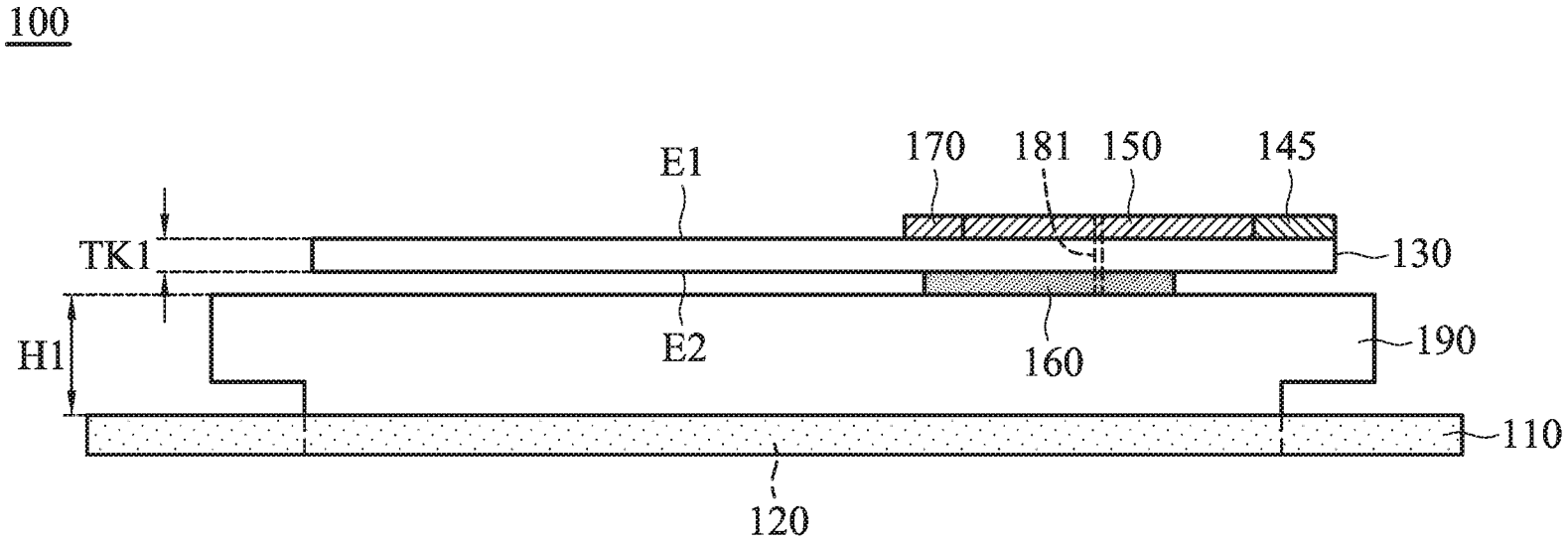
FIG. 1B is a side view of a mobile device according to an embodiment of the invention.

FIG. 1A is a top view of a mobile device 100 according to an embodiment of the invention. FIG. 1B is a side view of the mobile device 100 according to an embodiment of the invention. Please refer to FIG. 1A and FIG. 1B together. The mobile device 100 may be a smartphone, a tablet computer, or a notebook computer. In the embodiment of FIG. 1A and FIG. 1B, the mobile device 100 includes a metal back cover 110, a dielectric substrate 130, a grounding metal element 140, a first radiation element 150, a second radiation element 160, and a third radiation element 170. The first radiation element 150, the second radiation element 160, and the third radiation element 170 may be all made of metal materials, such as copper, silver, aluminum, iron, or their alloys. It should be understood that the mobile device 100 may further include other components, such as a processor, a touch control panel, a speaker, a battery module, and a housing, although they are not displayed in FIG. 1A and FIG. 1B.

The metal back cover 110 has a slot 120. The slot 120 may be substantially a straight-line-shaped opening. Specifically, the slot 120 is a closed slot having a first closed end 121 and a second closed end 122 which are away from each other. However, the invention is not limited to the above. In other embodiments, adjustments can be made such that the slot 120 can be a monopole slot having an open end and a closed end which are away from each other. If the mobile device 100 is implemented with a notebook computer or a deformable device, an edge of the metal back cover 110 can be adjacent to a hinge element (not shown) of the notebook computer or the deformable device. For example, the distance between the edge of the metal back cover 110 and the hinge element may be shorter than 10 mm.

The dielectric substrate 130 may be an FR4 (Flame Retardant 4) substrate, a PCB (Printed Circuit Board), or an FCB (Flexible Circuit Board). The dielectric substrate 130 has a first surface E1 and a second surface E2 which are opposite to each other. The first radiation element 150 and the third radiation element 170 are both disposed on the first surface E1 of the dielectric substrate 130. The second radiation element 160 is disposed on the second surface E2 of the dielectric substrate 130. The second surface E2 of the dielectric substrate 130 faces the slot 120 of the metal back cover 110, and is adjacent to the slot 120 of the metal back cover 110, such that an antenna structure is formed by the first radiation element 150, the second radiation element 160, the third radiation element 170, and the slot 120 of the metal back cover 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). The grounding metal element 140 may be coupled to the metal back cover 110, and both of them can provide a ground voltage of the mobile device 100. For example, the grounding metal element 140 may be a ground copper foil which extends from the metal back cover 110 to the first surface E1 of the dielectric substrate 110. Specifically, the grounding metal element 140 has an extension portion 145 on the first surface E1 of the dielectric substrate 130. The extension portion 145 of the grounding metal element 140 may substantially have a straight-line shape. As shown in FIG. 1B, the mobile device 100 may further include a plastic supporting element 190. The plastic supporting element 190 may be disposed on the metal back cover 110, and it can be configured to support and fix the dielectric substrate 130. The shape and size of the plastic supporting element 190 are not limited in the invention. It should be understood that the plastic supporting element 190 is an optional element, which is removable in other embodiments.

The first radiation element 150 has a feeding point FP, which may be coupled to a positive electrode of a signal source 199. A negative electrode of the signal source 199 may be coupled to the grounding metal element 140. For example, the signal source 199 may be an RF (Radio Frequency) module for generating a transmission signal or processing a reception signal, so as to excite the aforementioned antenna structure. In some embodiments, the positive electrode of the signal source 199 is coupled through a central conductive line of a coaxial cable to the feeding point FP, and the negative electrode of the signal source 199 is coupled through a conductive housing of the coaxial cable to the grounding metal element 140. The first radiation element 150 extends across the slot 120 of the metal back cover 110. That is, the first radiation element 150 has a first vertical projection on the metal back cover 110, and the first vertical projection at least partially overlaps the slot 120. In some embodiments, the first radiation element 150 substantially has a T-shape. Specifically, the first radiation element 150 has a first end 151, a second end 152, and a third end 153. The feeding point FP is positioned at the first end 151 of the first radiation element 150. The second end 152 and the third end 153 of the first radiation element 150 may substantially extend in opposite directions. The first radiation element 150 may have a width-varying structure. For example, the width of the third end 153 of the first radiation element 150 may be larger than the width of the second end 152 of the first radiation element 150, so as to fine-tune the impedance matching of the antenna structure. In addition, a coupling gap GC1 may be formed between the third end 153 of the first radiation element 150 and the extension portion 145 of the grounding metal element 140.

The second radiation element 160 extends across the slot 120 of the metal back cover 110. That is, the second radiation element 160 has a second vertical projection on the metal back cover 110, and the second vertical projection at least partially overlaps the slot 120. In addition, the first vertical projection of the first radiation element 150 at least partially overlaps the second vertical projection of the second radiation element 160. In some embodiments, the second radiation element 160 substantially has a T-shape. Specifically, the second radiation element 160 has a first end 161, a second end 162, and a third end 163. The second end 162 and the third end 163 of the second radiation element 160 may substantially extend in opposite directions. The second radiation element 160 may have a width-varying structure. For example, the width of the second end 162 of the second radiation element 160 may be larger than the width of the third end 163 of the second radiation element 160, so as to fine-tune the impedance matching of the antenna structure.

In some embodiments, the mobile device 100 further includes at least one first via element 181 made of a metal material. The first via element 181 penetrates the dielectric substrate 130. The first via element 181 is coupled between the first end 151 of the first radiation element 150 and the first end 161 of the second radiation element 160. It should be understood that the first via element 181 is an optional element, which is removable in other embodiments. With the first via element 181, the second radiation element 160 is directly excited by the signal source 199; Without the first via element 181, the second radiation element 160 is excited by the first radiation element 150 using a coupling mechanism. The two different methods of excitation do not affect the radiation performance of the antenna structure. In some embodiments, the mobile device 100 further includes at least one second via element 182 made of a metal material. The second via element 182 penetrates the dielectric substrate 130. The second via element 182 is coupled to the extension element 145 of the grounding metal element 140. It should be understood that the second via element 182 is an optional element, which is removable in other embodiments. In addition, the number of first via element(s) 181 and the number of second via element(s) 182 are adjustable according to different requirements.

The third radiation element 170 extends across the slot 120 of the metal back cover 110. That is, the third radiation element 170 has a third vertical projection on the metal back cover 110, and the third vertical projection at least partially overlaps the slot 120. In addition, the third vertical projection of the third radiation element 170 at least partially overlaps the second vertical projection of the second radiation element 160. In some embodiments, the third radiation element 170 substantially has a rectangular shape. The third radiation element 170 is coupled to the second end 152 of the first radiation element 150, so as to provide an additional current path and increase the operation bandwidth of the antenna structure. It should be understood that the third radiation element 170 is an optional element, which is removable in other embodiments.

Generally, the grounding metal element 140, the first radiation element 150, the second radiation element 160, and the third radiation element 170 are all relatively close to the second closed end 122 of the slot 120, and they are relatively away from the first closed end 121 of the slot 120. That is, the grounding metal element 140, the first radiation element 150, the second radiation element 160, and the third radiation element 170 are all positioned between the central point of the slot 120 and the second closed end 122, and they are not positioned between the central point of the slot 120 and the first closed end 121 Furthermore, each of the first radiation element 150, the second radiation element 160, and the third radiation element 170 can extend across the whole width W1 of the slot 120. According to practical measurements, such an element arrangement can optimize the impedance matching of the antenna structure.

Figure 2A:
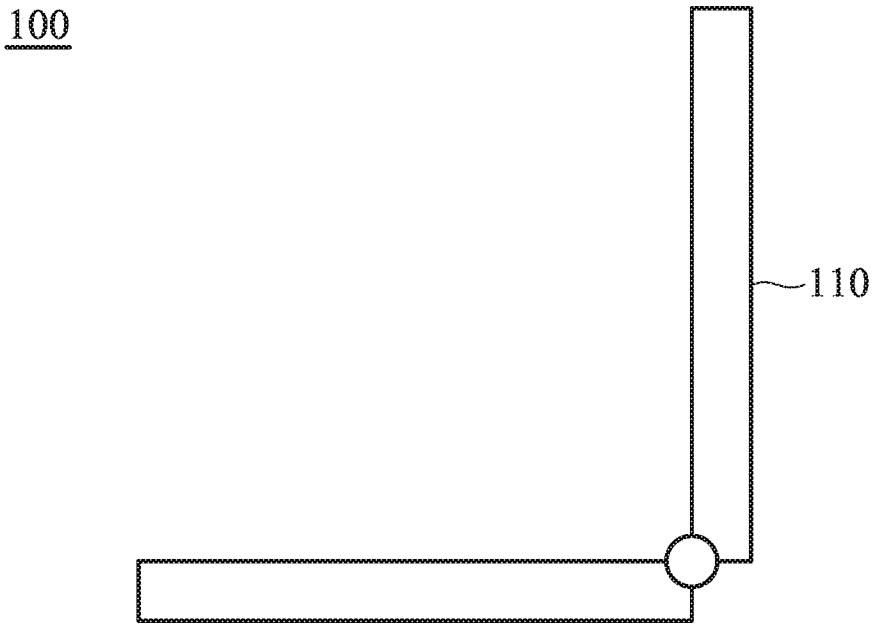
FIG. 2A is a view of a mobile device operating in a notebook mode according to an embodiment of the invention.
Figure 2B:
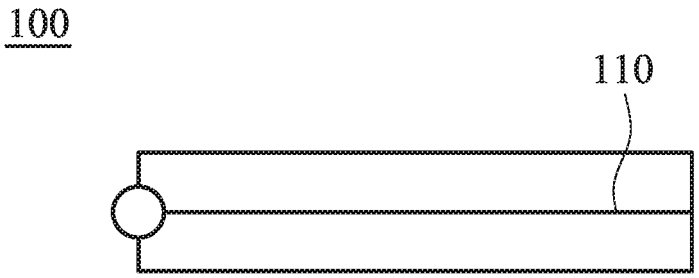
FIG. 2B is a view of a mobile device operating in a tablet mode according to an embodiment of the invention.

In some embodiments, the mobile device 100 and its antenna structure are implemented in a deformable device capable of switching between a notebook mode and a tablet mode. FIG. 2A is a view of the mobile device 100 operating in the notebook mode according to an embodiment of the invention. FIG. 2B is a view of the mobile device 100 operating in the tablet mode according to an embodiment of the invention.

Figure 3A:
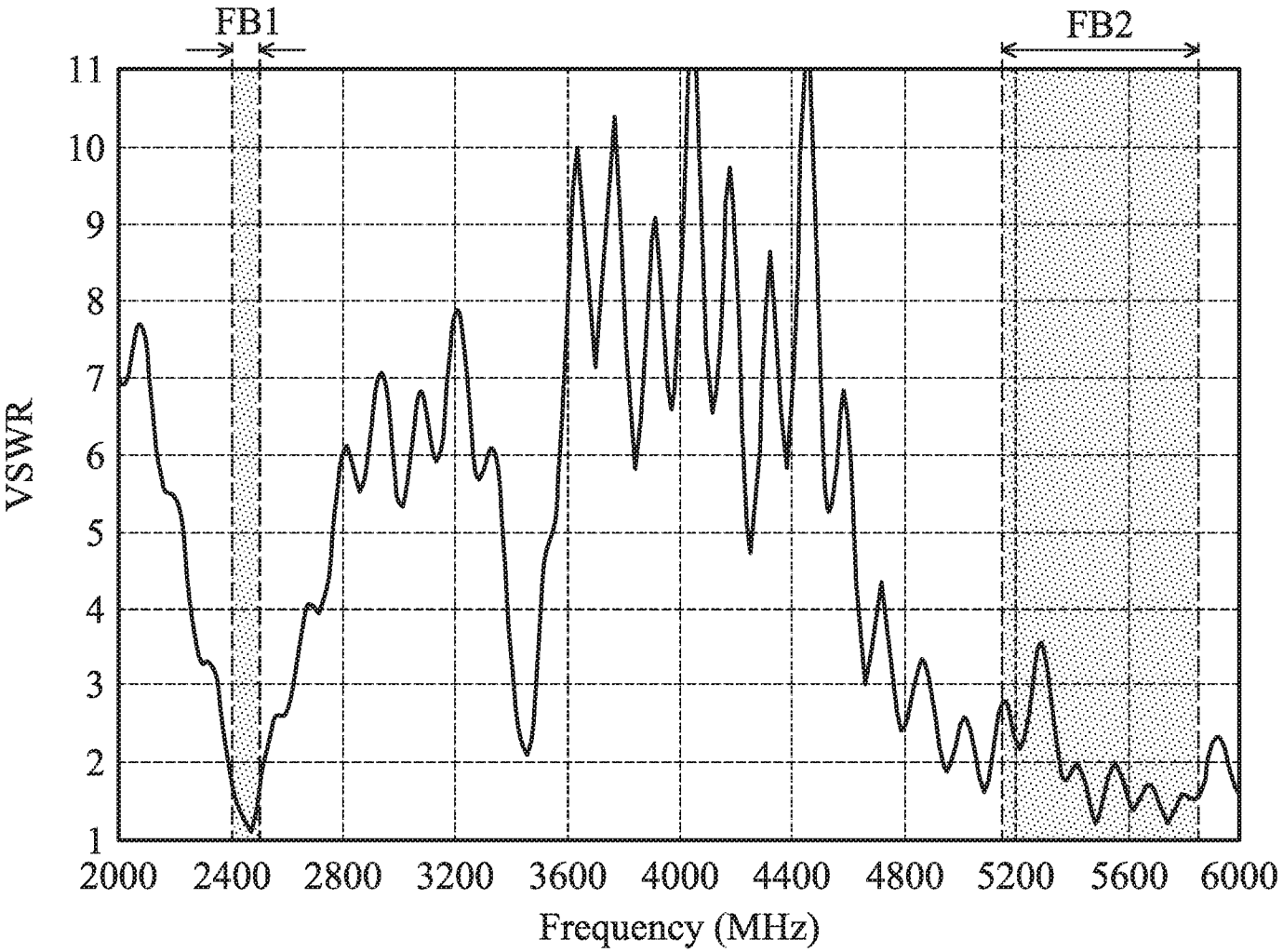
FIG. 3A is a diagram of VSWR (Voltage Standing Wave Ratio) of an antenna structure of a mobile device operating in a notebook mode according to an embodiment of the invention.
Figure 3B:
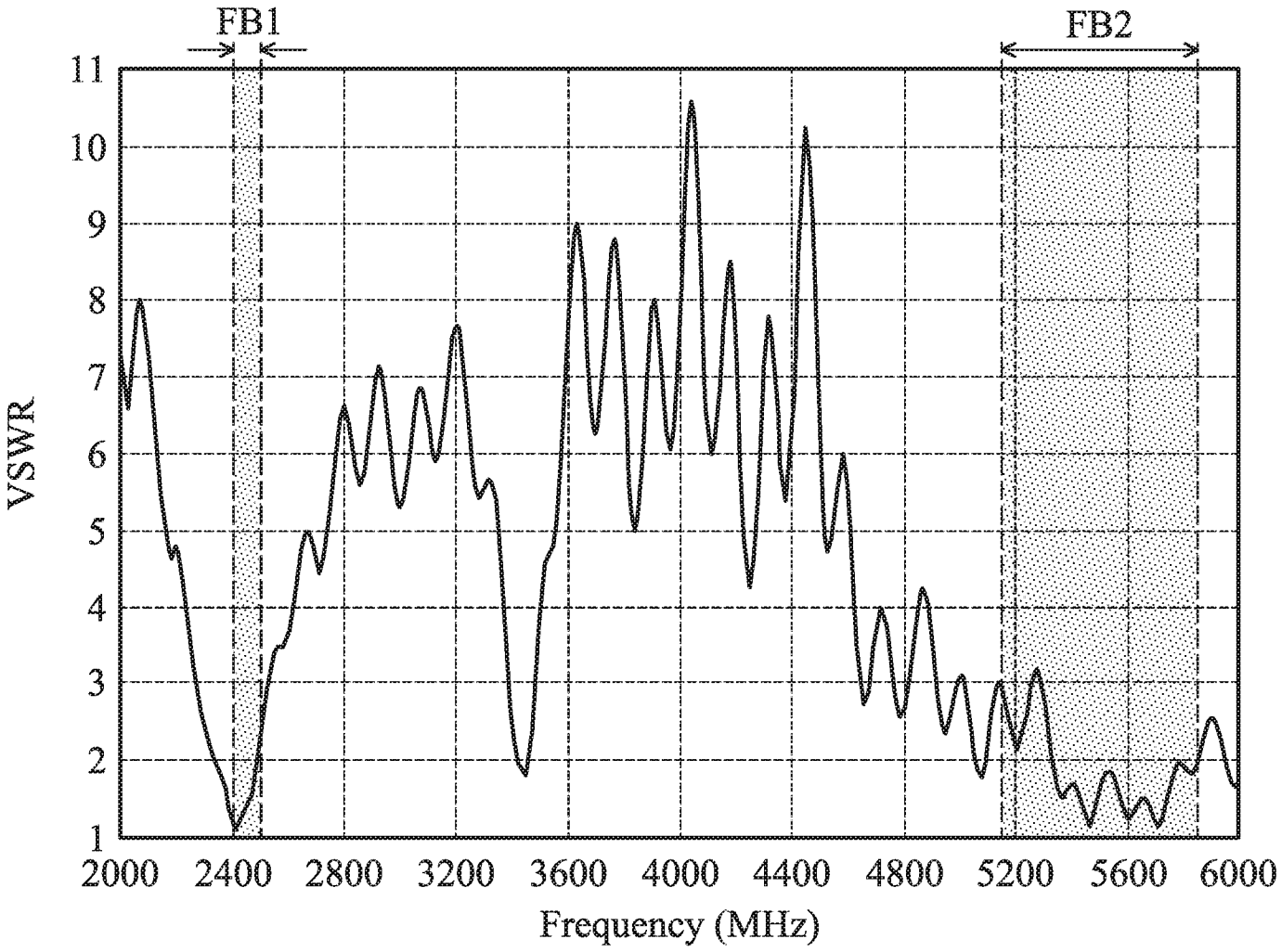
FIG. 3B is a diagram of VSWR of an antenna structure of a mobile device operating in a tablet mode according to an embodiment of the invention.

FIG. 3A is a diagram of VSWR (Voltage Standing Wave Ratio) of the antenna structure of the mobile device 100 operating in the notebook mode according to an embodiment of the invention. FIG. 3B is a diagram of VSWR of the antenna structure of the mobile device 100 operating in the tablet mode according to an embodiment of the invention. According to the measurement of FIGS. 3A and 3B, regardless of the notebook mode or the tablet mode, the antenna structure of the mobile device 100 can cover a first frequency band FB1 and a second frequency band FB2. The first frequency band FB1 may be from about 2400 MHz to about 2500 MHz. The second frequency band FB2 may be from about 5150 MHz to about 5850 MHz. Therefore, the antenna structure of the mobile device 100 can support at least the wideband operations of Bluetooth and WLAN (Wireless Local Area Network) 2.4 GHz/5 GHz. According to practical measurement, the antenna efficiency of the antenna structure of the mobile device 100 within the first frequency band FB1 is about −3.5 dB, and the antenna efficiency of the antenna structure of the mobile device 100 within the second frequency band FB2 is about −4.09 dB. The proposed design can meet the requirements of practical applications of general mobile communication devices.

In some embodiments, the operation principle of the antenna structure of the mobile device 100 is as follows. The first radiation element 150, the second radiation element 160, the third radiation element 170, and the slot 120 of the metal back cover 110 are excited to generate the first frequency band FB1. The first radiation element 150, the second radiation element 160, and the third radiation element 170 are excited to generate the second frequency band FB2.

In some embodiments, the element sizes of the mobile device 100 are as follows. The length of the slot 120 (i.e., the length from the first closed end 121 to the second closed end 122) may be substantially equal to 0.5 wavelength (λ/2) of the first frequency band FB1. The length from the first end 151 of the first radiation element 150 through the second end 152 of the first radiation element 150 to any edge of the third radiation element 170 may be substantially equal to 0.25 wavelength (λ/4) of the first frequency band FB1. The length from the first end 151 of the first radiation element 150 to the third end 153 of the first radiation element 150 may be substantially equal to 0.25 wavelength (λ/4) of the second frequency band FB2. The length from the first end 161 of the second radiation element 160 to the second end 162 of the second radiation element 160 may be substantially equal to 0.25 wavelength (λ/4) of the first frequency band FB1. The length from the first end 161 of the second radiation element 160 to the third end 163 of the second radiation element 160 may be substantially equal to 0.25 wavelength (λ/4) of the second frequency band FB2. In order to enhance the coupling effect between elements, the width of the coupling gap GC1 may be smaller than 3.5 mm, the thickness TK1 of the dielectric substrate 130 (or the distance between the first surface E1 and the second surface E2) may be smaller than 0.8 mm, and the height H1 of the plastic supporting element 190 (or the distance between the second radiation element 160 and the metal back cover 110) may be from 2 mm to 3 mm. The above element sizes are calculated and obtained according to many experiment results, and they can help to optimize the operation bandwidth and the impedance matching of the antenna structure of the mobile device 100.

The following embodiments will introduce different configurations of the proposed antenna structure. However, the figures and descriptions are merely exemplary, rather than limitations of the invention.

Figure 4:
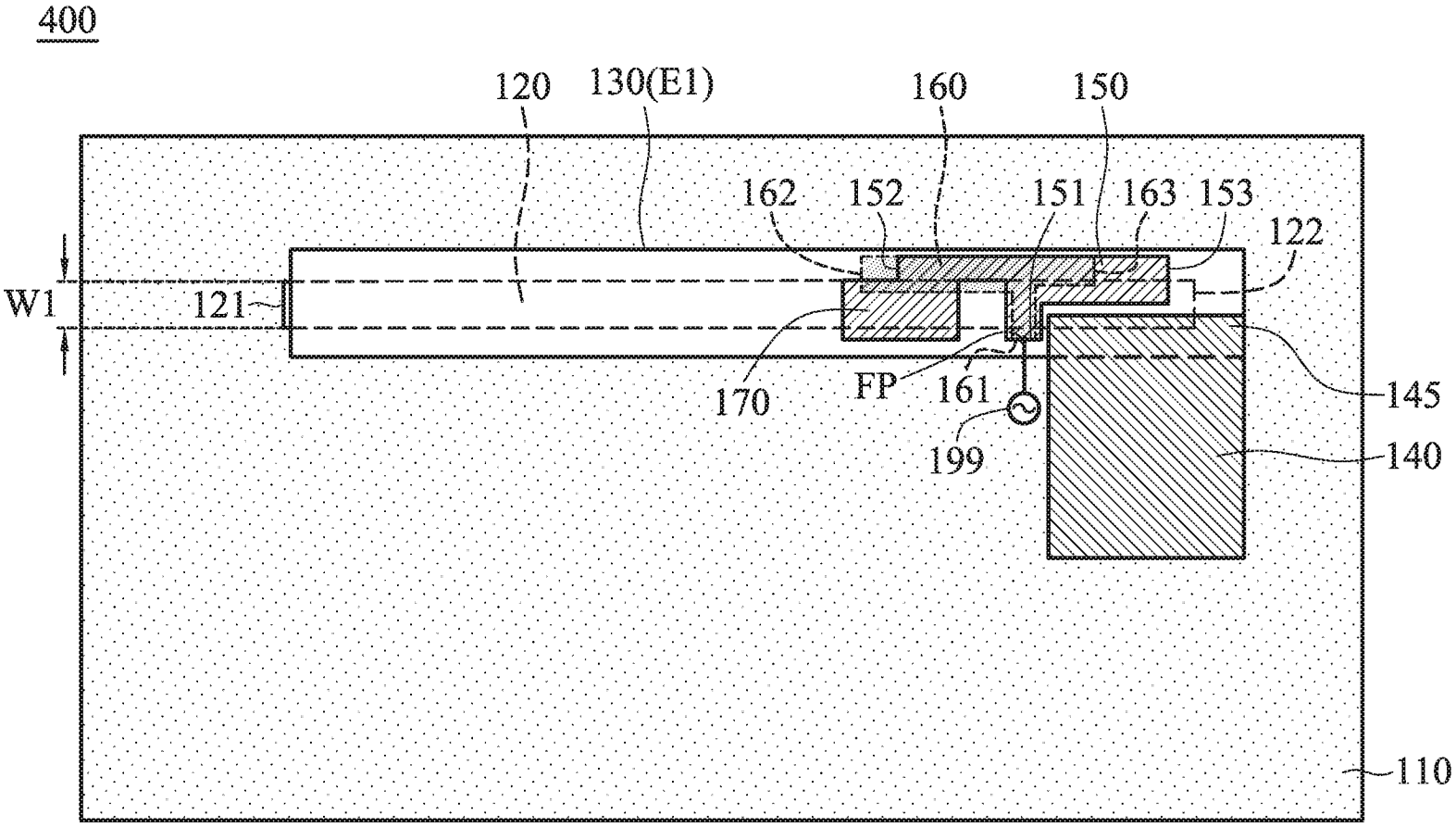
FIG. 4 is a top view of a mobile device according to an embodiment of the invention.

FIG. 4 is a top view of a mobile device 400 according to an embodiment of the invention. FIG. 4 is similar to FIG. 1A. In the embodiment of FIG. 4, the mobile device 400 does not include the first via element 181 and the second via element 182. With such a design, the second radiation element 160 is still excited by the first radiation element 150 using a coupling mechanism, without affecting the radiation performance of the antenna structure. Other features of the mobile device 400 of FIG. 4 are similar to those of the mobile device 100 of FIG. 1A and FIG. 1B. Accordingly, the two embodiments can achieve similar levels of performance.

Figure 5:
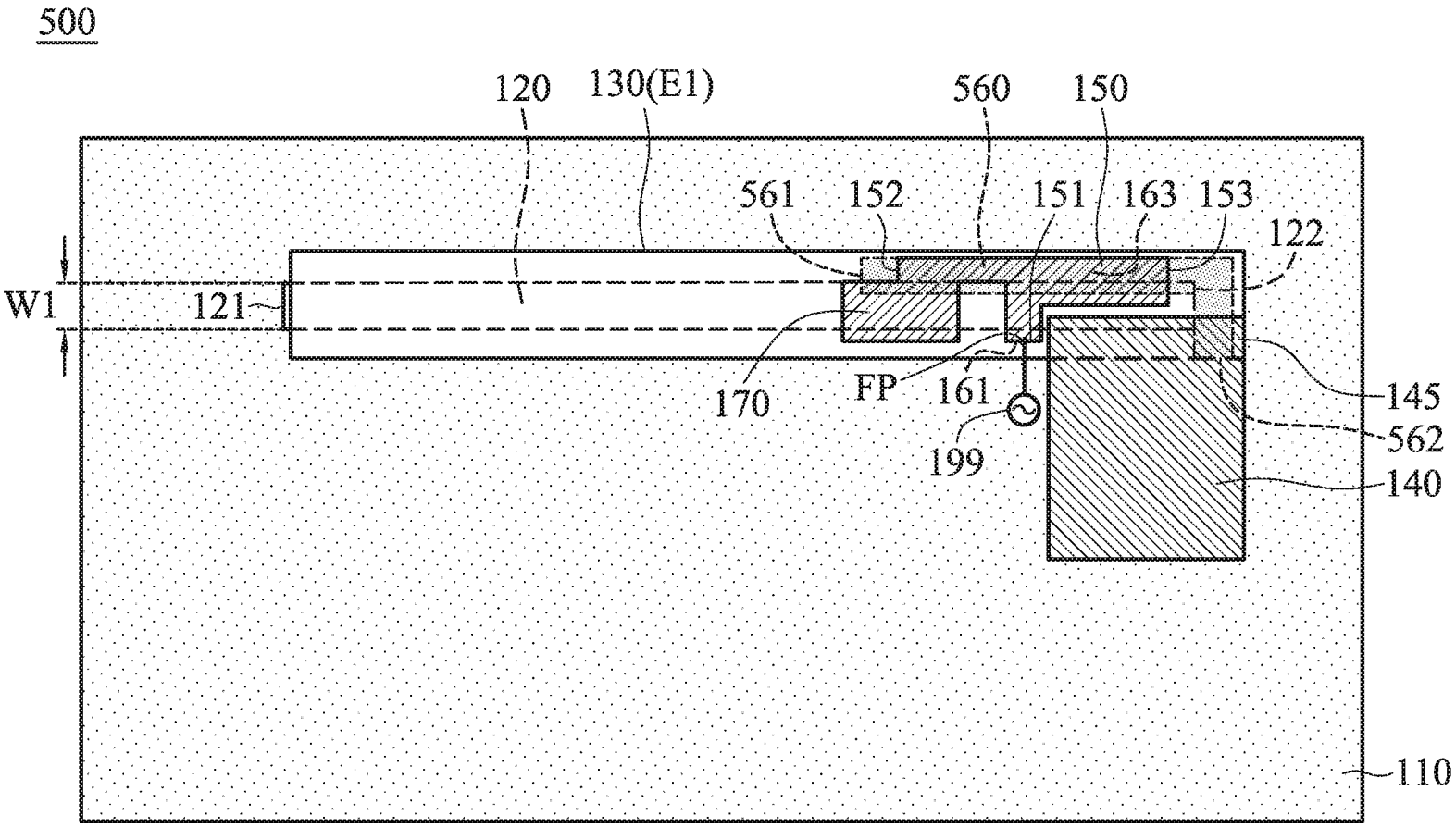
FIG. 5 is a top view of a mobile device according to an embodiment of the invention.

FIG. 5 is a top view of a mobile device 500 according to an embodiment of the invention. FIG. 5 is similar to FIG. 1A. In the embodiment of FIG. 5, the mobile device 500 also does not include the first via element 181 and the second via element 182, and a second radiation element 560 of the mobile device 500 is floating and substantially has an L-shape. A portion of the second radiation element 560 may be parallel to the slot 120, and another portion of the second radiation element 560 may be perpendicular to the slot 120. Specifically, the second radiation element 560 has a first end 561 and a second end 562, which are both open ends. The second end 562 of the second radiation element 560 is covered by the vertical projection of the extension portion 145 of the grounding metal element 140. The length of the second radiation element 560 (i.e., the length from the first end 561 to the second end 562) may be substantially equal to 0.5 wavelength (λ/2) of the first frequency band FB1.

According to the practical measurement, the adjustments of the shape and length of the second radiation element 560 can increase the bandwidth of the first frequency band FB1 of the antenna structure of the mobile device 500. Other features of the mobile device 500 of FIG. 5 are similar to those of the mobile device 100 of FIG. 1A and FIG. 1B. Accordingly, the two embodiments can achieve similar levels of performance.

Figure 6:
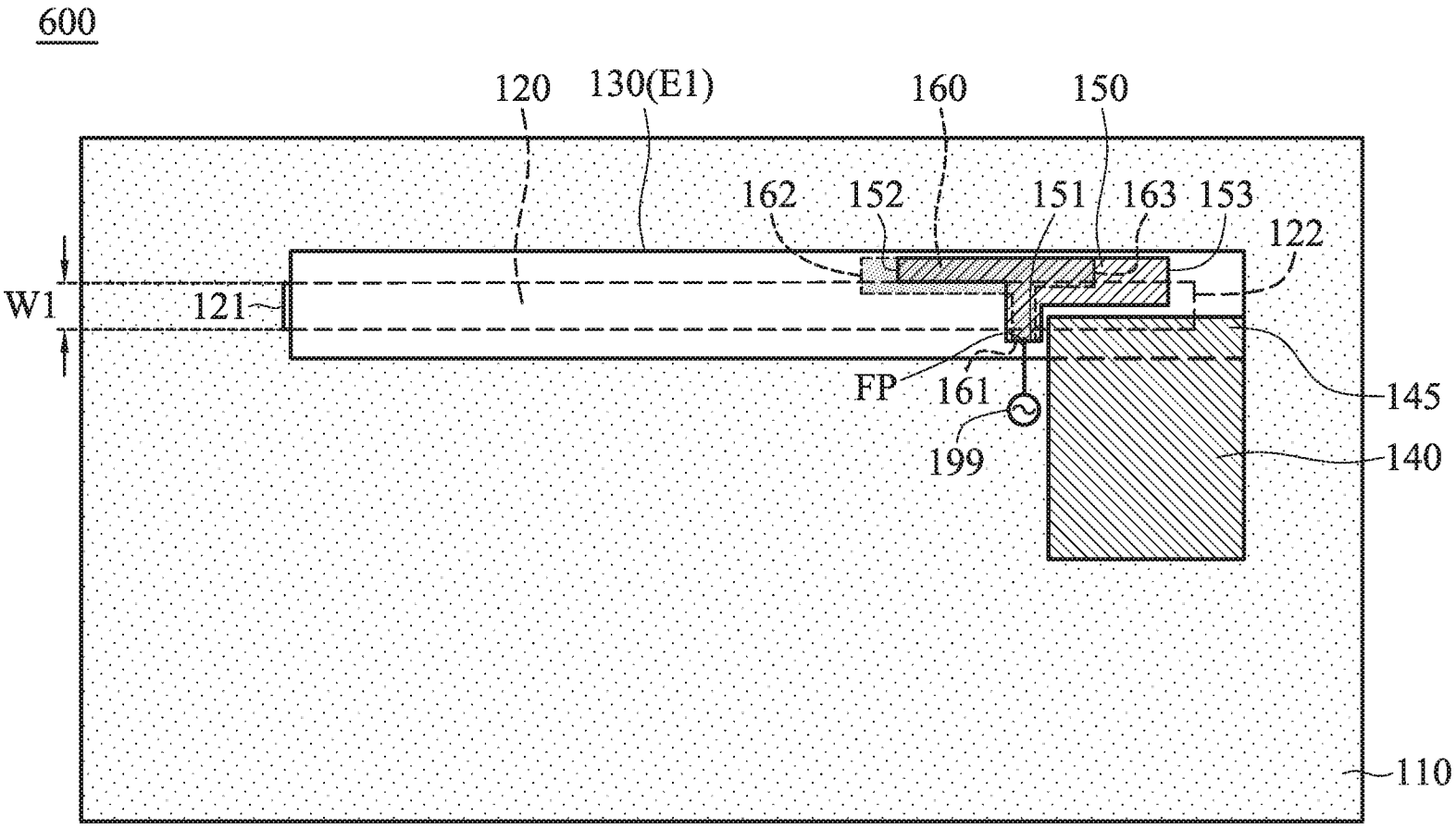
FIG. 6 is a top view of a mobile device according to an embodiment of the invention.

FIG. 6 is a top view of a mobile device 600 according to an embodiment of the invention. FIG. 6 is similar to FIG. 1A. In the embodiment of FIG. 6, the mobile device 600 does not include the first via element 181, the second via element 182, and the third radiation element 170. With such a design, the first radiation element 150, the second radiation element 160, and the slot 120 of the metal back cover 110 are still excited to generate the first frequency band FB1, without affecting the radiation performance of the antenna structure. The length from the first end 151 of the first radiation element 150 to the second end 152 of the first radiation element 150 may be substantially equal to 0.25 wavelength ($\lambda/4$) of the second frequency band FB2, so as to increase the bandwidth of the second frequency band FB2. Other features of the mobile device 600 of FIG. 6 are similar to those of the mobile device 100 of FIG. 1A and FIG. 1B. Accordingly, the two embodiments can achieve similar levels of performance.

Figure 7:
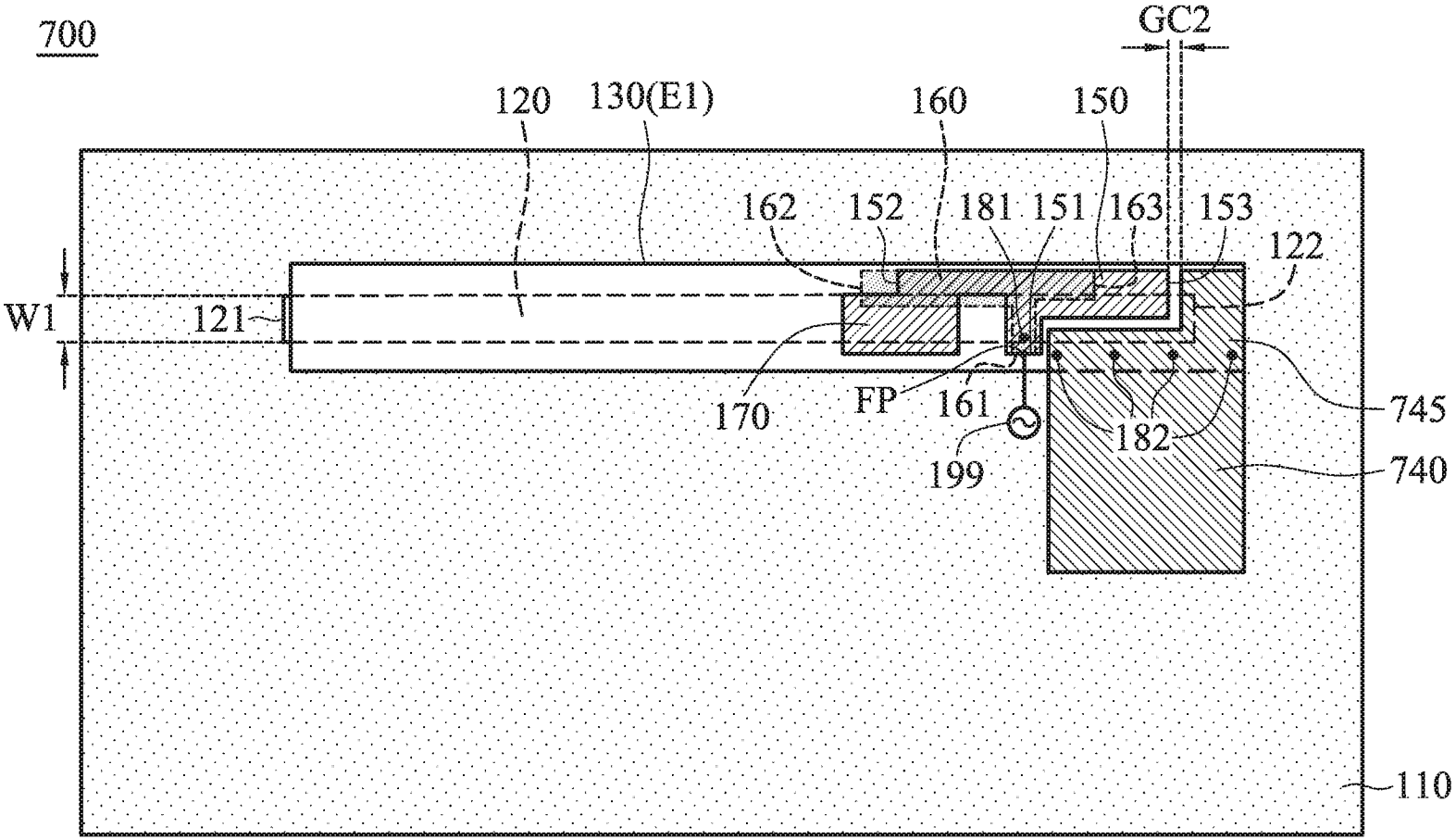
FIG. 7 is a top view of a mobile device according to an embodiment of the invention.

FIG. 7 is a top view of a mobile device 700 according to an embodiment of the invention. FIG. 7 is similar to FIG. 1A. In the embodiment of FIG. 7, a grounding metal element 740 of the mobile device 700 has an extension portion 745 on the first surface E1 of the dielectric substrate 130. The extension portion 745 of the grounding metal element 740 substantially has an L-shape, such that the second closed end 122 of the slot 120 is completely covered by the vertical projection of the extension portion 745. A coupling gap GC2 is formed between the third end 153 of the first radiation element 150 and the extension portion 745 of the grounding metal element 740. The width of the coupling gap GC2 may be smaller than 3.5 mm. According to the practical measurement, the L-shaped extension portion 745 can increase the bandwidth of the second frequency band FB2. Other features of the mobile device 700 of FIG. 7 are similar to those of the mobile device 100 of FIG. 1A and FIG. 1B. Accordingly, the two embodiments can achieve similar levels of performance.

Figure 8:
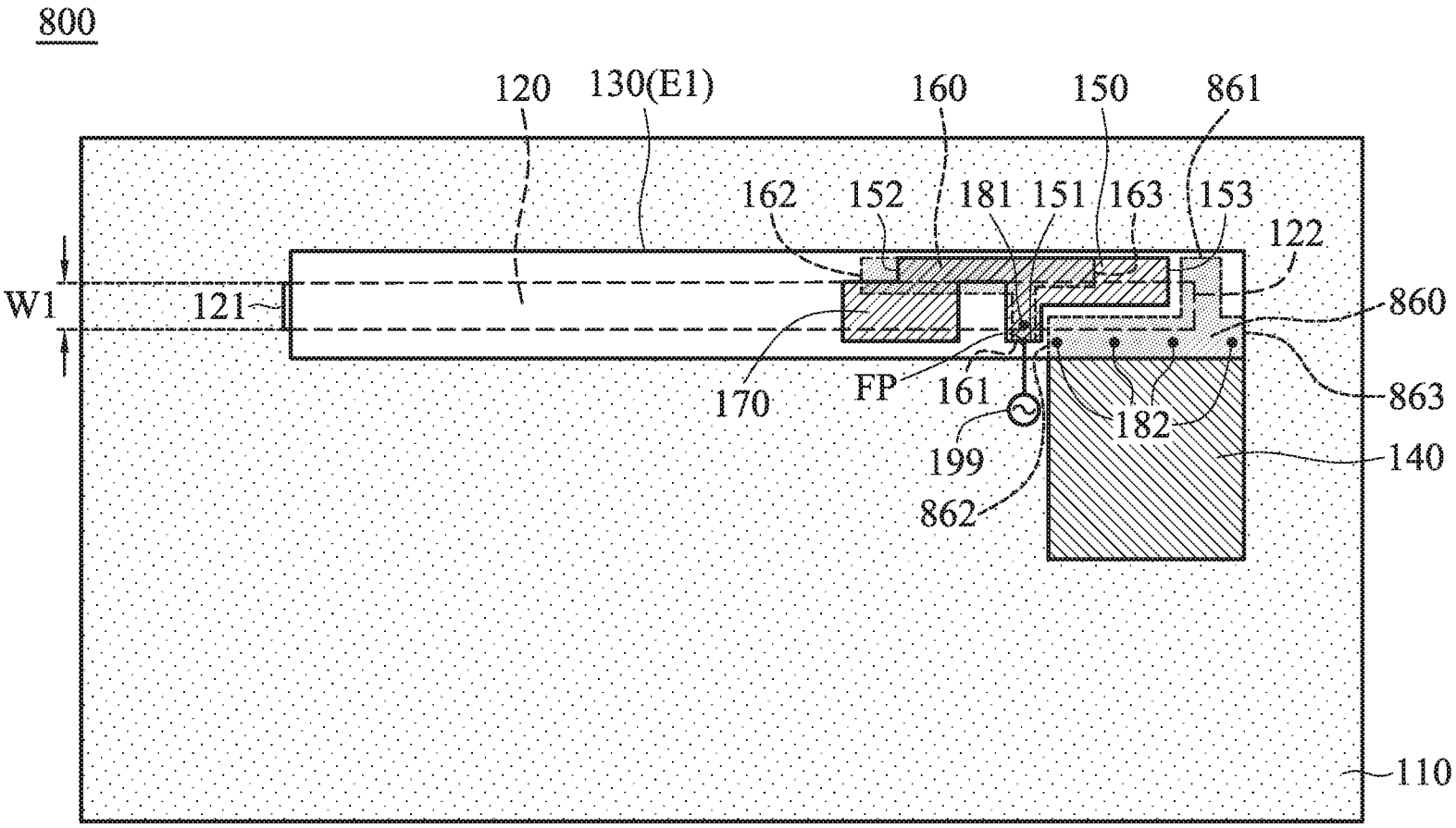
FIG. 8 is a top view of a mobile device according to an embodiment of the invention.

FIG. 8 is a top view of a mobile device 800 according to an embodiment of the invention. FIG. 8 is similar to FIG. 1A. In the embodiment of FIG. 8, the mobile device 800 further includes a fourth radiation element 860 made of a metal material. The fourth radiation element 860 is disposed on the second surface E2 of the dielectric substrate 130. The fourth radiation element 860 extends across the slot 120 of the metal back cover 110. That is, the fourth radiation element 860 has a fourth vertical projection on the metal back cover 110, and the fourth vertical projection at least partially overlaps the slot 120. The fourth radiation element 860 substantially has an inverted T-shape. Specifically, the fourth radiation element 860 has a first end 861, a second end 862, and a third end 863, which are all open ends. The second end 862 and the third end 863 of the fourth radiation element 860 may substantially extend in opposite directions. The fourth radiation element 860 may have an equal-width structure. For example, the first width 861, the second width 862, and the third width 863 of the fourth radiation element 860 may be the same. The length from the first end 861 to the second end 862 of the fourth radiation element 860 may be greater than the length from the first end 861 to the third end 863 of the fourth radiation element 860. In some embodiments, at least one second via element 182 penetrates the dielectric substrate 130. The second via element 182 is coupled between the extension portion 145 of the grounding metal element 140 and the fourth radiation element 860. According to the practical measurement, the incorporation of the fourth radiation element 860 can increase the bandwidths of both the first frequency band FB1 and the second frequency band FB2. It should be understood that the second via element 182 is an optional element, which is removable in other embodiments (if so, the fourth radiation element 860 will become floating). Other features of the mobile device 800 of FIG. 8 are similar to those of the mobile device 100 of FIG. 1A and FIG. 1B. Accordingly, the two embodiments can achieve similar levels of performance.

The invention proposes a novel antenna structure with a slot. When the antenna structure is used in a mobile device that includes a metal back cover, it effectively prevents the metal back cover from negatively affecting the communication quality of the mobile device because the metal back cover is considered as an extension portion of the antenna structure. When the mobile device is a deformable device, the antenna structure can provide good radiation performance, regardless of whether the deformable device is operating in notebook mode or tablet mode. It should be also noted that the invention can improve the appearance and design of the mobile device, without opening any antenna windows on the metal back cover. In comparison to the conventional design, the invention has at least the advantages of small size, wide bandwidth, high antenna efficiency in the high and low frequency bands, strong device stability, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-8. The invention may merely include any one or more features of any one or more embodiments of FIGS. 1-8. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal back cover, having a slot;

a dielectric substrate, having a first surface and a second surface opposite to the first surface, wherein the second surface of the dielectric substrate faces the slot;

a grounding metal element, coupled to the metal back cover, and extending onto the first surface of the dielectric substrate;

a first radiation element, having a feeding point, and disposed on the first surface of the dielectric substrate, wherein the first radiation element has a first vertical projection on the metal back cover, the first vertical projection at least partially overlaps the slot, and a coupling gap is formed between the first radiation element and the grounding metal element; and a second radiation element, disposed on the second surface of the dielectric substrate, wherein the second radiation element has a second vertical projection on the metal back cover, and the second vertical projection at least partially overlaps the slot;

wherein an antenna structure is formed by the first radiation element, the second radiation element, and the slot of the metal back cover.

2. The mobile device as claimed in claim 1, wherein the slot is a closed slot.

3. The mobile device as claimed in claim 1, wherein the first vertical projection of the first radiation element at least partially overlaps the second vertical projection of the second radiation element.

4. The mobile device as claimed in claim 1, wherein the grounding metal element is a grounding copper foil.

5. The mobile device as claimed in claim 1, wherein the first radiation element substantially has a T-shape.

6. The mobile device as claimed in claim 1, wherein the second radiation element substantially has a T-shape.

7. The mobile device as claimed in claim 1, further comprising:

a first via element, penetrating the dielectric substrate, wherein the first via element is coupled between the first radiation element and the second radiation element.

8. The mobile device as claimed in claim 1, further comprising:

a third radiation element, coupled to the first radiation element, and disposed on the first surface of the dielectric substrate, wherein the third radiation element has a third vertical projection on the metal back cover, and the third vertical projection at least partially overlaps the slot.

9. The mobile device as claimed in claim 8, wherein the third radiation element substantially has a rectangular shape.

10. The mobile device as claimed in claim 8, wherein the antenna structure covers a first frequency band from 2400 MHz to 2500 MHz and a second frequency band from 5150 MHz to 5850 MHz.

11. The mobile device as claimed in claim 10, wherein the first radiation element, the second radiation element, the third radiation element, and the slot of the metal back cover are excited to generate the first frequency band.

12. The mobile device as claimed in claim 10, wherein the first radiation element, the second radiation element, and the third radiation element are excited to generate the second frequency band.

13. The mobile device as claimed in claim 10, wherein a length of the slot is substantially equal to 0.5 wavelength of the first frequency band.

14. The mobile device as claimed in claim 1, wherein the second radiation element is floating and substantially has an L-shape.

15. The mobile device as claimed in claim 1, wherein the grounding metal element has an extension portion on the first surface of the dielectric substrate, and the extension portion substantially has a straight-line shape or an L-shape.

16. The mobile device as claimed in claim 15, wherein the coupling gap between the first radiation element and the extension portion of the grounding metal element is smaller than 3.5 mm.

17. The mobile device as claimed in claim 15, further comprising:

a fourth radiation element, disposed on the second surface of the dielectric substrate, wherein the fourth radiation element has a fourth vertical projection on the metal back cover, and the fourth vertical projection at least partially overlaps the slot.

18. The mobile device as claimed in claim 17, wherein the fourth radiation element substantially has an inverted T-shape.

19. The mobile device as claimed in claim 17, further comprising:

a second via element, penetrating the dielectric substrate, wherein the second via element is coupled between the extension portion of the grounding metal element and the fourth radiation element.

20. The mobile device as claimed in claim 1, wherein a thickness of the dielectric substrate is smaller than 0.8 mm.

* * * * *